United States Patent [19]

Blotenberg

[11] Patent Number: 4,749,331

[45] Date of Patent: Jun. 7, 1988

[54] METHOD AND APPARATUS OF DETECTING PUMPING SURGES ON TURBOCOMPRESSORS

[75] Inventor: Wilfried Blotenberg, Dinslaken, Fed. Rep. of Germany

[73] Assignee: MAN Gutehoffnungshütte GmbH, Fed. Rep. of Germany

[21] Appl. No.: 928,467

[22] Filed: Nov. 7, 1986

[30] Foreign Application Priority Data

Nov. 12, 1985 [DE] Fed. Rep. of Germany ..... 3540088

[51] Int. Cl.[4] ..... F01D 17/02

[52] U.S. Cl. ..... 415/47; 415/1; 73/116; 340/966

[58] Field of Search ..... 415/47, 118, 13, 17, 415/1; 73/116, 115; 340/966

[56] References Cited

U.S. PATENT DOCUMENTS

| | | | |
|---|---|---|---|
| 2,696,345 | 12/1954 | Hopper | 415/17 |
| 3,291,146 | 12/1966 | Walker | 415/17 |
| 4,464,720 | 8/1984 | Agarwal | 415/17 |
| 4,502,833 | 3/1985 | Hibino et al. | 415/17 |
| 4,505,150 | 3/1985 | Seymour et al. | 73/116 |
| 4,594,050 | 6/1986 | Gaston | 415/47 |
| 4,612,894 | 9/1986 | Satoh et al. | 73/116 |

FOREIGN PATENT DOCUMENTS

| | | | |
|---|---|---|---|
| 2828124 | 11/1981 | Fed. Rep. of Germany . | |
| 156905 | 12/1979 | Japan | 415/47 |

*Primary Examiner*—Edward K. Look
*Assistant Examiner*—John T. Kwon
*Attorney, Agent, or Firm*—McGlew and Tuttle

[57] ABSTRACT

To detect a surge in a turbocompressor, the temperature at the compressor intake, or the difference between temperatures measured at different distances from the compressor intake, is subjected to a differentiation or to an operation equivalent to differentiation, thereby determining the temperature change rate. A surge is indicated when the temperature change rate is above a specified value and possibly other plausibility criteria are met.

6 Claims, 1 Drawing Sheet

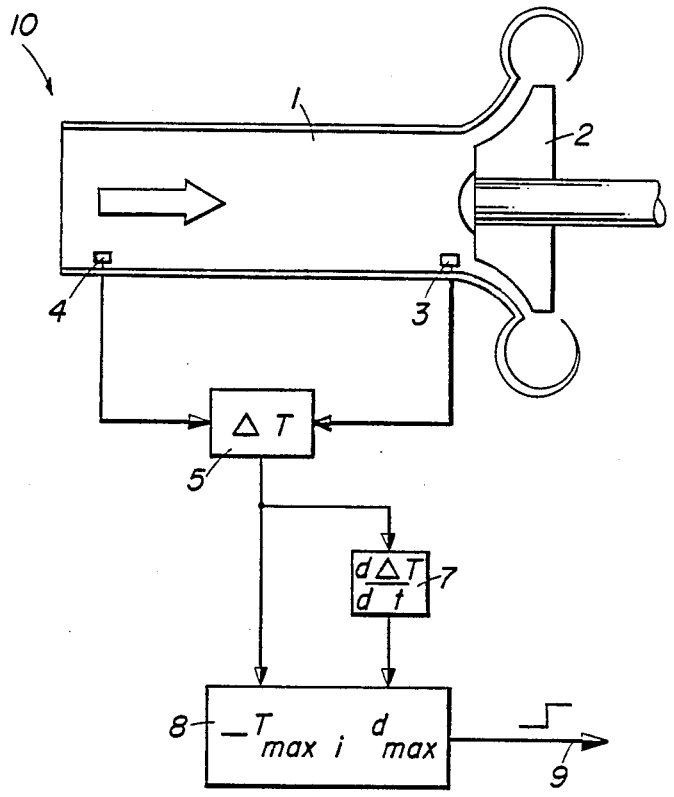
10
1
2
4
3
ΔT
5
dΔT/dt
7
8
T max i d max
9

METHOD AND APPARATUS OF DETECTING PUMPING SURGES ON TURBOCOMPRESSORS

FIELD AND BACKGROUND OF THE INVENTION

This invention relates in general to compressors and in particular to a new and useful device and method for detecting surges in turbocompressors.

The invention relates particularly to a method of detecting surges in turbocompressors similar to that disclosed in U.S. Pat. No. 2,929,547.

A process in a turbocompressor in which the pumped medium flows from the compression side back to the suction side periodically, is called surge. This process takes place in operating states of too great a compression ratio between outlet and inlet pressures, or, of too low a throughput volume. Since the pumped medium heats up due to the compression in the compressor, the pumped medium flowing back during a surge is also hotter than the aspirated medium so that a surge results in a change of the temperature conditions at the compressor intake. The change in temperature may be utilized as an indicator of the presence of a surge to trigger measures for the elimination of the surge, e.g. the opening of a blow-off valve.

At 0.5 to 2 seconds, the pumping cycle of a compressor is relatively short. It is difficult to detect these short temperature changes with conventional temperature sensors. In addition, the daily and seasonal temperature fluctuations of the aspirated air mean an interference in air compressors, or the process related aspiration temperature fluctuations in gas compressors. In compressors with intermediate cooling, the coolant temperature and quantity wield an influence. All of these interfering influences may lead to the surges not being detected quickly enough or, when operating conditions change, not reliably enough, for which reason the countermeasures are also either not triggered at all or are triggered too late.

SUMMARY OF THE INVENTION

The invention provides a method of detecting surges which is reliable and substantially free of interfering influences.

Accordingly, it is an object of the invention to provide a method and apparatus for detecting surges on turbocompressors which comprises monitoring the temperature at least at one point of the compressor intake and deriving a signal indicating a surge from a temperature rise by determining the speed of which the temperature rises which is acquired by a differentiation so that the signal is generated whenever the rate at which the temperature rise exceeds the specified value.

A further object of the invention is to provide a device for determining when surging arises in a compressor which includes two sensors arranged at spaced locations in the suction of the compressor which are connected to a difference element having a differential stage which is connected to a comparator so as to produce an output line signal indicating a temperature rise beyond a predetermined amount which indicates a surge.

A further object of the invention is to provide a device for indicating a surge in a compressor which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

The only FIGURE of the drawings is a schematic indication of an apparatus for indicating a surging stage in a compressor constructed in accordance with the invention.

DESCRIPTION OF THE PREFERRED EMBODIMENT

Referring to the drawing in particular, the invention embodied therein comprises a method of an apparatus for detecting surges in turbocompressors generally designated 10 which comprises monitoring the temperature at least at a single point 3 in the suction channel 1 of a compressor ahead of a first impeller 2. With the embodiment illustrated, the temperature is measured both at point 3 and at 4 which is further removed from the impeller 2. The temperature rise is determined by a difference element 5 and the speed of which this temperature rise occurs is acquired by a differentiation 7 so that a signal generated in an output line 9 occurs whenever the rate at the which the temperature rise exceeds a specified value.

A temperature sensor 3 is mounted in a suction channel 1 of a turbocompressor 10 directly ahead of the first impeller 2, and another temperature sensor 4 is mounted at a slightly greater distance from the first impeller 2. In the event of a surge, the hot pumped medium flowing back through the impellers affects mainly the temperature sensor 3, whereas the temperature sensor 4, being further away from the impeller 2, is essentially exposed to the suction flow only and experiences no temperature change. Furthermore, the temperature sensor 3 may be designed to be quick responding and the temperature sensor 4 thermally sluggish.

In a difference element 5, the temperature difference $\Delta T$ of the temperatures acquired by the temperature sensors 3 and 4 is formed. The differential element 5 is unnecessary if the temperature sensors 3,4 are thermocouples wired against each other so that the acquisition signal corresponds to the temperature difference. The temperature difference is differentiated in a differentiation stage 7 to form the time derivation $d\,\Delta T/dt$. The temperature differences and their time derivation are compared with specified limits $\Delta T_{max}$ and $d_{max}$ in a comparator 8, and a signal indicating a pumping surge is generated in the output line 9 if the two limits are exceeded.

Instead of a differentiation in the actual sense, another operation equivalent to differentiation may also be carried out to detect the speed with which the change takes place. For instance, it is known from German patent No. 28 28 124 to acquire the change of speed as an actual value by feeding the actual value or its difference from the set point value once undelayed, and once delayed, to a substracting element so that the difference between the undelayed and the delayed value is obtained as "quasi-differentiated" signal. In the scope of the invention, such an operation can also be applied to the temperature signal.

While a specific embodiment of the invention has been shown and described in detail to illustrate the application of the principles of the invention, it will be understood that the invention may be embodied otherwise without departing from such principles.

What is claimed is:

1. A method of detecting pumping surges on turbocompressors comprising monitoring temperature at least at one point of the compressor intake, and deriving a signal indicating a surge from a temperature rise by determining the speed at which the temperature rises by time differentiation so that the signal is generated whenever the rate at which the temperature rise exceeds the specified value.

2. A method according to claim 1, wherein the signal is generated only when both the temperature rise rate and the absolute value of the temperature change are both above a specified value.

3. A method according to claim 1, wherein the difference of temperatures is acquired at two measuring points located adjacent and remote from the first impeller and that this temperature difference is time differentiated.

4. An apparatus for detecting surges in a compressor having a rotatable impeller comprising a suction line feeding to the first impeller, at least two spaced apart temperature sensors in said suction line arranged adjacent and remote from said first impeller, a differential element connected to each of said sensors for determining at least one of the differences of the temperatures and the rate of rise of temperature including a time differential stage and a comparator connected to said differential element for producing a signal whenever the temperature change rises above a predetermined level.

5. A method according to claim 3, wherein the signal is generated only when both the time differential of the temperature difference at the two measuring points and the absolute value of the temperature difference at the two measuring points are above a specified value.

6. An apparatus for detecting surges in a compressor having a rotatable impeller and comprising a suction line feeding a first impeller, at least two spaced apart temperature sensors in said suction line arranged adjacent and remote from said first impeller, circuit means for connecting said temperature sensors for producing a first signal corresponding to a difference in their temperatures; a time differentiating circuit connected to the circuit means for receiving the first signal and for producing a second signal corresponding to the time differential of the first signal; and, a comparator connected to said circuit means and said differentiating circuit to receive said first and second signals and for generating a third signal signifying a surge condition when said first and second signals exceed a specified value.

* * * * *